US008523026B2

(12) United States Patent
Tseng et al.

(10) Patent No.: US 8,523,026 B2
(45) Date of Patent: Sep. 3, 2013

(54) GARMENT HANGER

(75) Inventors: Yu-Hao Howard Tseng, Vancouver (CA); Gareth Brown, Jersey City, NJ (US); John Thomas Jacobsen, Brooklyn, NY (US)

(73) Assignee: Quirky Incorporated, New York, NY (US)

( * ) Notice: Subject to any disclaimer, the term of this patent is extended or adjusted under 35 U.S.C. 154(b) by 0 days.

(21) Appl. No.: 13/232,390

(22) Filed: Sep. 14, 2011

(65) Prior Publication Data

US 2012/0234875 A1 Sep. 20, 2012

Related U.S. Application Data

(60) Provisional application No. 61/385,547, filed on Sep. 22, 2010.

(51) Int. Cl.
*A41D 27/22* (2006.01)

(52) U.S. Cl.
USPC ..... 223/94; 223/85

(58) Field of Classification Search
USPC ..... 223/85, 89, 90, 94, 92
See application file for complete search history.

(56) References Cited

U.S. PATENT DOCUMENTS

| | | | | |
|---|---|---|---|---|
| 586,456 | A | 7/1897 | Rideout | |
| 2,418,870 | A * | 4/1947 | Crowder | 223/89 |
| 2,440,637 | A * | 4/1948 | Lowe | 223/94 |
| 2,699,276 | A * | 1/1955 | Goodman | 223/94 |
| 2,745,579 | A * | 5/1956 | Goodman | 223/94 |
| 2,810,500 | A * | 10/1957 | Wingate | 223/89 |
| 3,082,921 | A | 3/1963 | Sadowsky | |
| 3,151,788 | A * | 10/1964 | Wingate | 223/88 |
| 3,705,673 | A * | 12/1972 | Mohammar | 223/94 |
| 3,874,572 | A | 4/1975 | McClenning | |
| 4,186,857 | A | 2/1980 | Helms, Jr. | |
| 4,524,890 | A | 6/1985 | Fulton | |
| 4,988,021 | A | 1/1991 | Adams et al. | |
| 5,383,584 | A | 1/1995 | Adams | |
| 5,690,257 | A | 11/1997 | Ward | |

(Continued)

FOREIGN PATENT DOCUMENTS

| | | |
|---|---|---|
| DE | 20117582 | 1/2002 |
| FR | 2780870 | 1/2000 |
| JP | 8141287 | 6/1996 |
| WO | WO2008062540 | 5/2008 |

OTHER PUBLICATIONS

International Search Report and Written Opinion for International Application No. PCT/US2011/051521, mailed Dec. 23, 2011, 14 pages.

*Primary Examiner* — Nathan Durham

(57) ABSTRACT

An apparatus and methods for hanging a garment are described herein. In some embodiments, an apparatus includes a first arm with a first end portion and a second end portion and a second arm with a first end portion and a second end portion. The first end portion of the first arm includes a hook configured to be disposed over a closet rod. The second arm is rotatably coupled to the first arm between a first expanded configuration and a second collapsed configuration. The first end portion of the second arm is configured to selectively engage the closet rod and hold the hanger in the expanded configuration. The second portion of the first arm and the second portion of the second arm are collectively configured to hang a garment.

16 Claims, 13 Drawing Sheets

(56) References Cited

U.S. PATENT DOCUMENTS 6,050,460 A * 4/2000 Licari et al. ..... 223/94
6,328,187 B2 12/2001 Sugita
7,246,729 B2 7/2007 Harvey et al.
7,249,699 B2 7/2007 Hill et al.
7,481,341 B2 1/2009 Liang
2010/0059557 A1 3/2010 Temali et al.

* cited by examiner

GARMENT HANGER

CROSS-REFERENCE TO RELATED APPLICATION

This application claims priority to and the benefit of U.S. Provisional Patent Application Ser. No. 61/385,547, filed Sep. 22, 2010, entitled "Rotatable Garment Hanger for Easy Hang and Retrieval of Garments," the disclosure of which is hereby incorporated by reference in its entirety.

BACKGROUND

The present invention generally relates to an apparatus and methods for hanging garments, and particularly to a collapsible garment hanger.

Garment hangers or "hangers" can be used to hang garments from a rod, hook, handle, and/or the like. Typically, hangers include a hook and a pair of arms extending laterally from the base of the hook, such that a garment can hang from the arms. In such instances, the use of the hanger can be complicated by the necessary length of the arms. For example, when inserting the hanger into a garment one may place the first arm through the collar opening of the garment followed by the second arm. Often the neck of the garment is stretched over time due to insertion of the arms of the hanger through the collar opening. Fitting freshly laundered button up shirts, polo shirts, or any similar garments onto a rigid hanger in the conventional manner can be time consuming because one has to unbutton the shirt, place it on the hanger, and then re-button the shirt. Alternatively, one may choose to insert the hanger through the bottom opening of a garment (e.g., a shirt, dress, blouse, or the like) to avoid stretching the neck opening or unbuttoning. In this process, the hanger can become tangled in the body of the garment as one tries to bring the hook portion through the neck of the garment.

Thus, a need exists for a garment hanger that includes a rotatable joint between at least the first arm and the second arm, thereby allowing the arms to collapse.

SUMMARY

An apparatus and methods for hanging a garment are described herein. In some embodiments, a collapsible garment hanger includes a first arm having a first end portion and a second end portion and a second arm having a first end portion and a second end portion. The first end portion of the first arm includes a hook configured to be disposed over a closet rod to support the collapsible garment hanger. The second arm is coupled to the first arm for rotational movement relative to the first arm between an expanded configuration and a collapsed configuration. The first end portion of the second arm is configured to selectively engage the closet rod and hold the hanger in the expanded configuration.

DETAILED DESCRIPTION

Figure 1A:
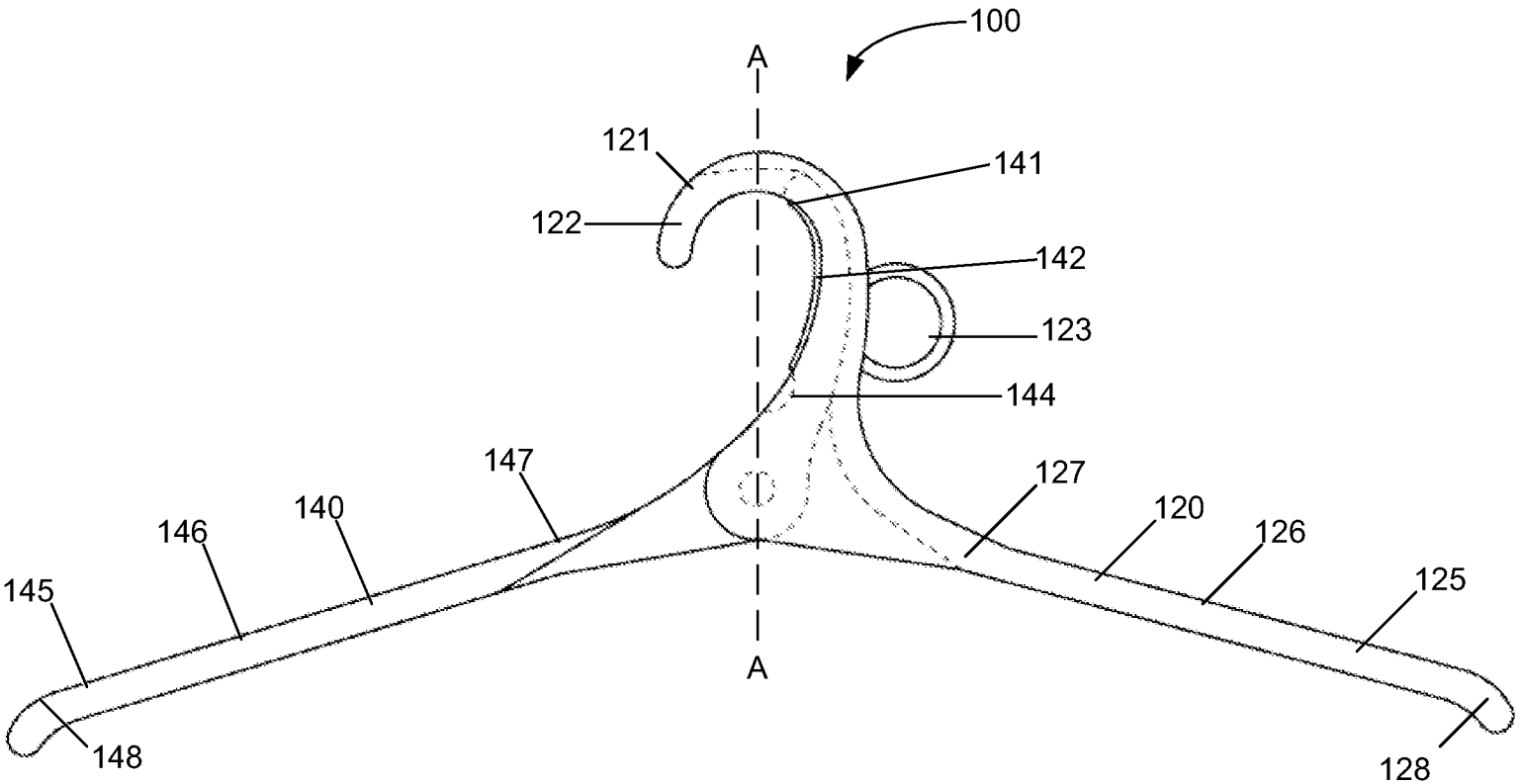
FIG. 1A is a front view of a collapsible hanger in an expanded configuration according to an embodiment.

An apparatus and methods for hanging a garment are described herein. In some embodiments, an apparatus for hanging garments includes a first arm having a first end portion and a second end portion and a second arm having a first end portion and a second end portion. The first end portion of the first arm includes a hook configured to be disposed over a closet rod. The second arm is coupled to the first arm for rotational movement relative to the first arm between an expanded configuration and a collapsed configuration. The first end portion of the second arm is configured to selectively engage the closet rod and hold the hanger in the expanded configuration. The first end portion of the second arm can also include a hook configured to be disposed over the closet rod, the hook, the hanger, and/or the like and hold the hanger in the expanded configuration. The apparatus can further include, for example, a locking mechanism to lock the hanger in the expanded configuration. The first arm can include a first housing segment and a second housing segment, and the first and second housing segments can collectively define a slot for receiving the second arm.

In some embodiments, an apparatus for hanging garments includes a first arm having a first hook configured to be disposed over a closet rod and a second arm having a second hook configured to be disposed over a closet rod. The second arm is coupled to the first arm for rotational movement relative to the first arm between an expanded configuration and a collapsed configuration. The first hook and the second hook can be configured to hold the garment hanger in the expanded configuration without a separate locking mechanism. The apparatus can further include a locking mechanism to lock the garment hanger in the expanded configuration.

In some embodiments, an apparatus for hanging garments includes a support hook, a first arm coupled to the support hook, and a second arm coupled to the first arm for rotational movement relative to the first arm between an expanded configuration and a collapsed configuration. The first arm can be separate from or unitarily formed with the support hook. At least a portion of the second arm is configured to selectively engage a closet rod and hold the garment hanger in the expanded configuration without a separate locking mechanism. The second arm can further include a second support hook configured to hold the garment hanger in the expanded configuration. The apparatus can further include a locking mechanism to lock the garment hanger in the expanded configuration.

In some embodiments, an apparatus for hanging garments includes a first arm having a first hook configured to be disposed over a closet rod and a second arm having a second hook configured to be disposed over a closet rod. The second arm can include an aperture configured to receive a pivot pin included in the first arm. The second arm can be coupled to the first arm for rotational movement relative to the first arm between an expanded configuration and a collapsed configuration. The apparatus can further include a pivot mechanism independent of the first arm and can couple the second arm to the first for rotational movement relative to the first arm between an expanded configuration and a collapsed configuration.

It is noted that, as used in this written description and the appended claims, the singular forms "a," "an" and "the" include plural referents unless the context clearly dictates otherwise. Thus, for example, the term "an arm" is intended to mean a single arm or a combination of arms. Furthermore, the words "proximal" and "distal" refer to a direction closer to and away from, respectively, the center of rotation of the hanger (i.e., the pin).

Figure 1B:
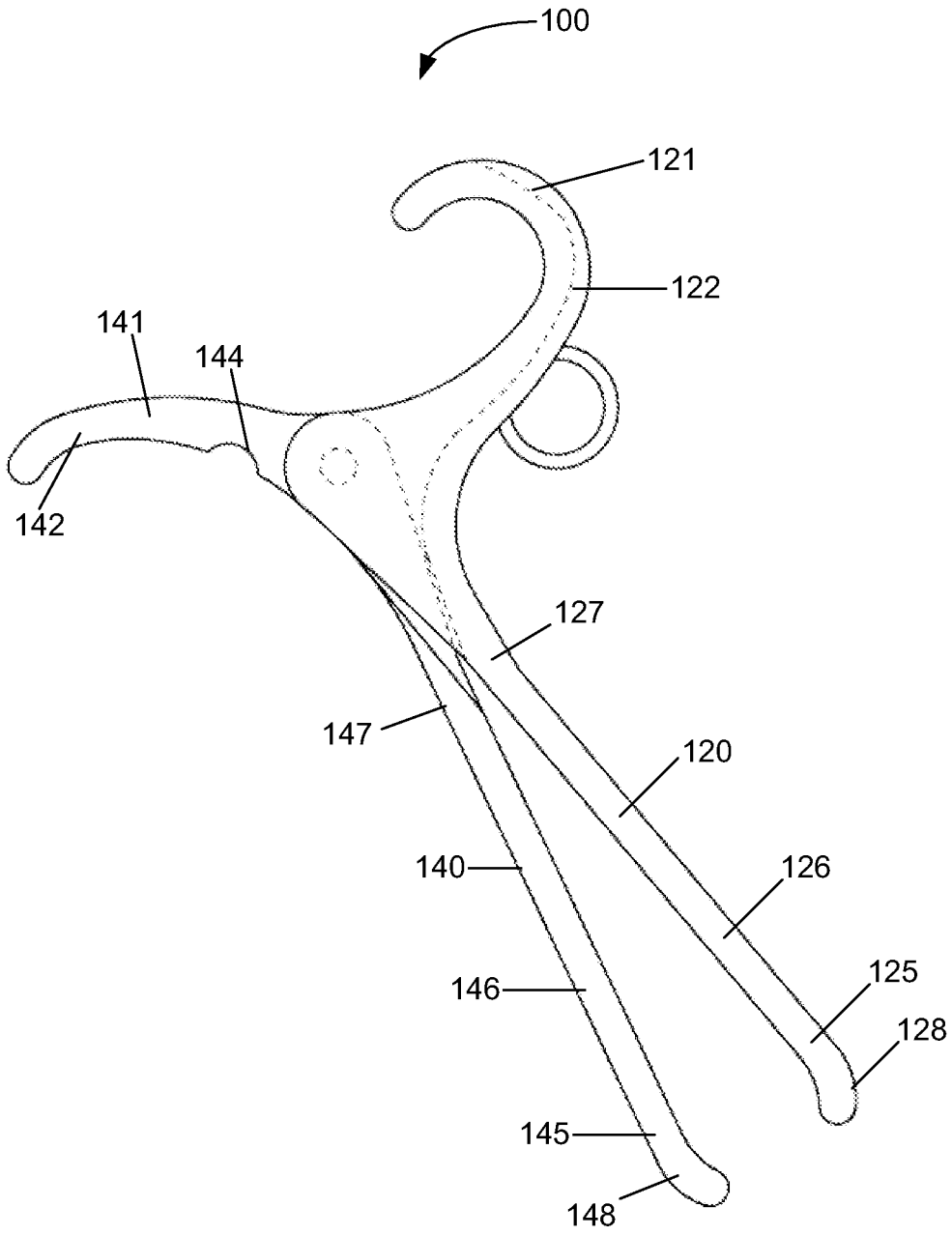
FIG. 1B is a front view of the collapsible hanger of FIG. 1A in a collapsed configuration.
Figure 1C:
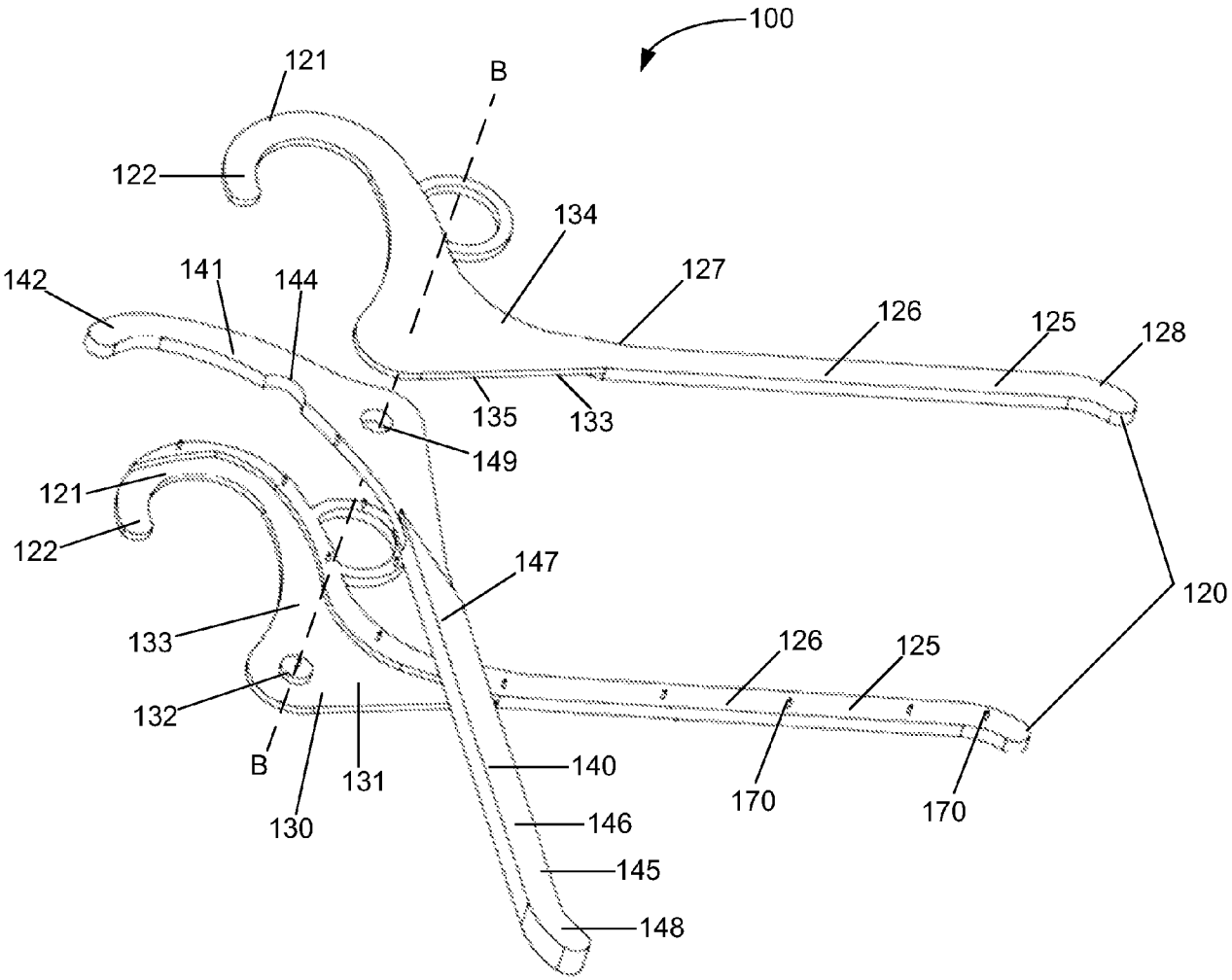
FIG. 1C is an exploded view of the collapsible hanger of FIG. 1A

FIGS. 1A-1C illustrate a garment hanger 100 according to an embodiment. The garment hanger 100 (also referred to herein as a "hanger") can be used to hang a garment from a closet rod, a hook, a handle, and/or the like. The hanger 100 includes a first arm 120 with a first end portion 121 and a second end portion 125, and second arm 140 with a first end portion 141 and a second end portion 145.

The first end portion 121 of the first arm 120 includes a hook 122 configured to be disposed over, for example, a closet rod. The hook 122 can be any suitable shape, size, or configuration. For example, in some embodiments, the hook 122 can have a large radius of curvature such that the hook 122 can fit around a large diameter closet rod. In other embodiments, the hook 122 can have a small radius of curvature such that the hook 122 can fit around a relatively small diameter of a hook, for example, a hook found in a vehicle. Additionally, the first end portion 121 can include a ring 123. The ring 123 can be any suitable size, shape or configuration. In use, one can place a thumb or finger through the ring 123 for better control and grip of the hanger 100.

The second end portion 125 of the first arm 120 includes a boom 126 extending away from the first end portion 121. The boom 126 can be configured to extend away from the first end portion 121 in a downward fashion such that a distal end 128 of the second end portion 125 is below a proximal end 127 of the second end portion 125, as shown, for example, in FIG. 1A. Furthermore, the boom 126 extends away from the proximal end 127 in a substantially linear path and, at the distal end 128, the boom 126 curves further downward with a given radius of curvature, so as to facilitate a smooth insertion of the distal end 128 into the collar opening of a garment. In some embodiments, the boom 126 can extend away from the first end portion 121 in a substantially arcuate and/or non-linear path.

The first end portion 141 of the second arm 140 includes an extension 142 configured to selectively engage, for example, a closet rod. Similar to the hook 122 of the first arm 120, the extension 142 can be any suitable shape, size, or configuration. The extension 142 is configured to engage at least a portion of a closet rod to hold the hanger in an expanded configuration when the hook 122 is disposed over the closet rod. The extension 142 can include a finger support 144. The finger support 144 can be configured to help prevent one's fingers from sliding off the extension 142 while in use. The finger support 142 can be any suitable size, shape, or configuration. For example, as shown in FIG. 1B, the finger support 144 is a contour in the underside of the extension 142. The finger support 144 can be an over mold of a material substantially different from the hanger 100, such as, for example, rubber or low durometer plastic and can be configured to increase the friction between the extension 142 and the user's finger.

The second end portion 145 of the second arm 140 includes a boom 146 extending away from the first end portion 141. Similar to the boom 126 of the first arm 120, the boom 146 can extend away from the first end portion 141 in a downward path. In some embodiments, the boom 146 extends away from a proximal end 147 in a linear path and, at a distal end 148, the boom 146 curves downward with a given radius of curvature, similar to the boom 126. In other embodiments, the boom 146 extends away from the first end portion 141 in an arcuate and/or non-linear path. Furthermore, the boom 126 of the first arm 120 and the boom 146 of the second arm 140 are configured to follow a substantially mirrored path about a vertical plane A, as shown in FIG. 1A.

The hanger 100 is configured to collapse, fold, rotate, and/or otherwise move between the expanded configuration (FIG. 1A) and a collapsed configuration (FIG. 1B). The first portion 141 of the second arm 140 can be such that when the hanger 100 is no longer in contact with the closet rod, the extension 142 is configured to pivot away from the hook 122 of the first arm 120. More specifically, the second arm 140 is configured to pivot about a pin 132 extending from the first arm 120, described in more detail with respect to FIG. 1C.

Referring now to FIG. 1C, the first arm 120 includes a first housing segment 130 with an inner surface 131 and a second housing segment 134 with an inner surface 135. The first housing segment 130 includes protrusions 170 extending outward from the inner surface 131 that are configured to fit within a set of apertures (not shown) defined by the inner surface 135 of the second housing segment 134. More specifically, the protrusions 170 create a friction fit with the set of apertures such that the first housing segment 130 and the second housing segment 134 can be coupled to each other.

The inner surface 131 of the first housing segment and the inner surface 135 of the second housing segment 134 collectively define a slot 133. The second arm 140 is configured to be disposed within the slot 133 defined by the inner surface 131 of the first housing segment 130 and the inner surface 135 of the second housing segment 134. As described above, the second arm 140 is rotatably coupled to the pin 132 extending from the inner surface 131. More specifically, the second arm 140 includes an aperture 149 configured to receive at least a portion of the pin 132. In this manner, the hanger 100 is configured to collapse, rotate, and/or otherwise move between the first expanded configuration (FIG. 1A) and the second collapse configuration (FIG. 1B). More specifically, when the extension 142 is not in contact with, for example, a closet rod, the pin 132, being at least partially disposed within the aperture 149 defined by the second arm 140, acts as a pivot point for the second arm 140 to rotate about toward the second collapsed configuration (FIG. 1B). This arrangement allows for the insertion of the hanger 100 through a garment with a small collar opening without the need for stretching the collar. Furthermore, when the hanger 100 and more specifically the extension 142 is again placed in contact with the closet rod, the hanger 100 can return to the first expanded configuration (FIG. 1A).

Figure 2A:
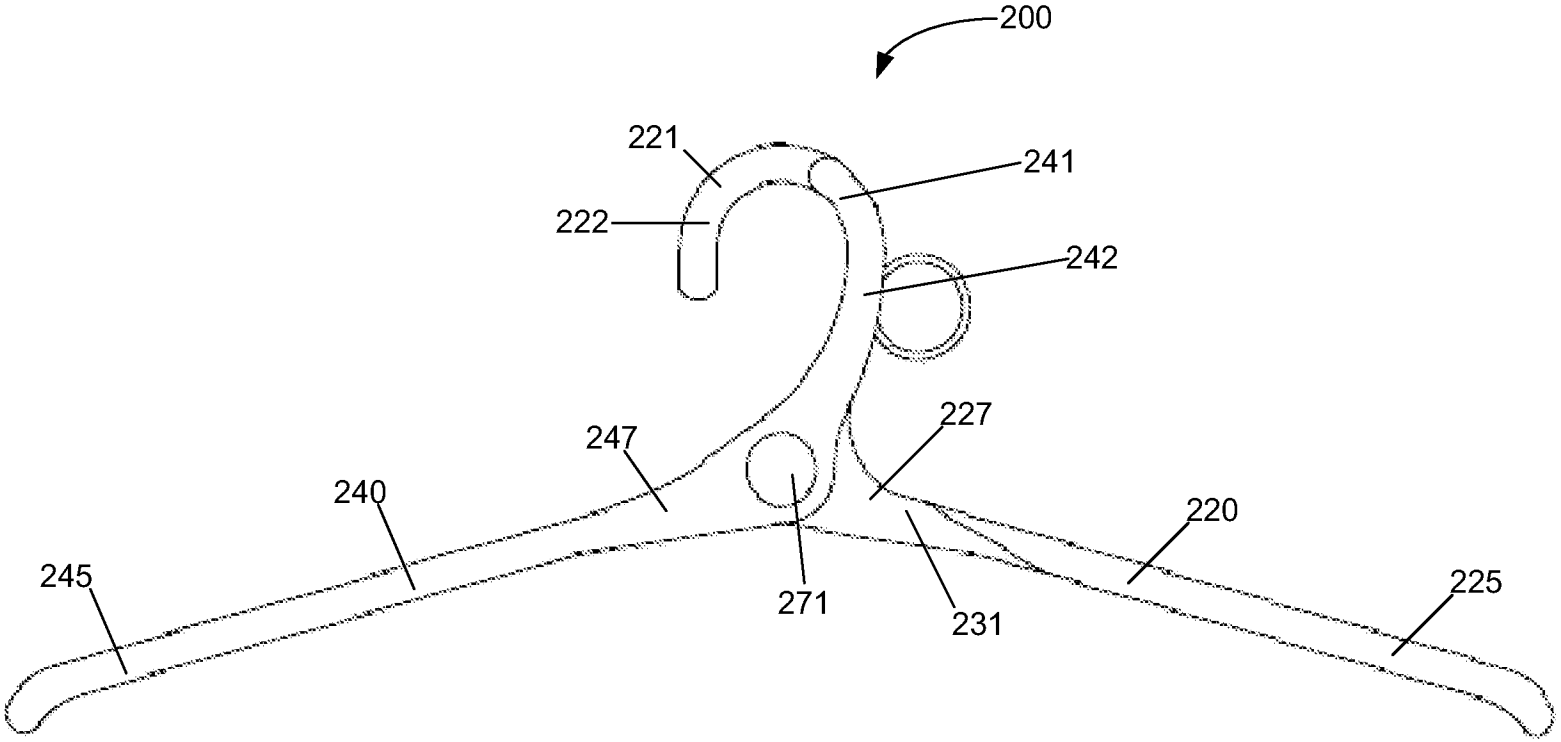
FIG. 2A is a front view of a collapsible hanger in an expanded configuration according to another embodiment.
Figure 2B:
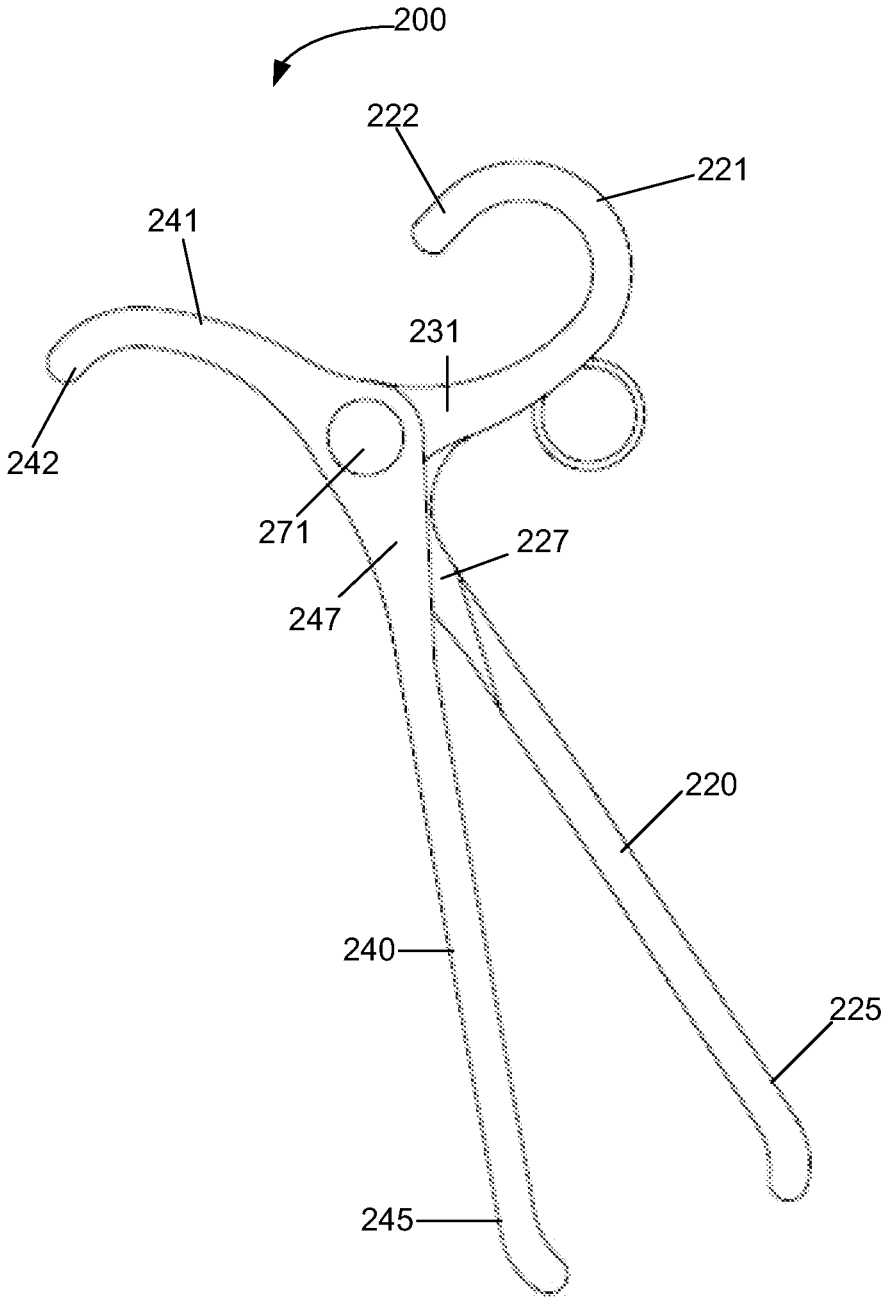
FIG. 2B is a front view of the collapsible hanger of FIG. 2A in a collapsed configuration.
Figure 2C:
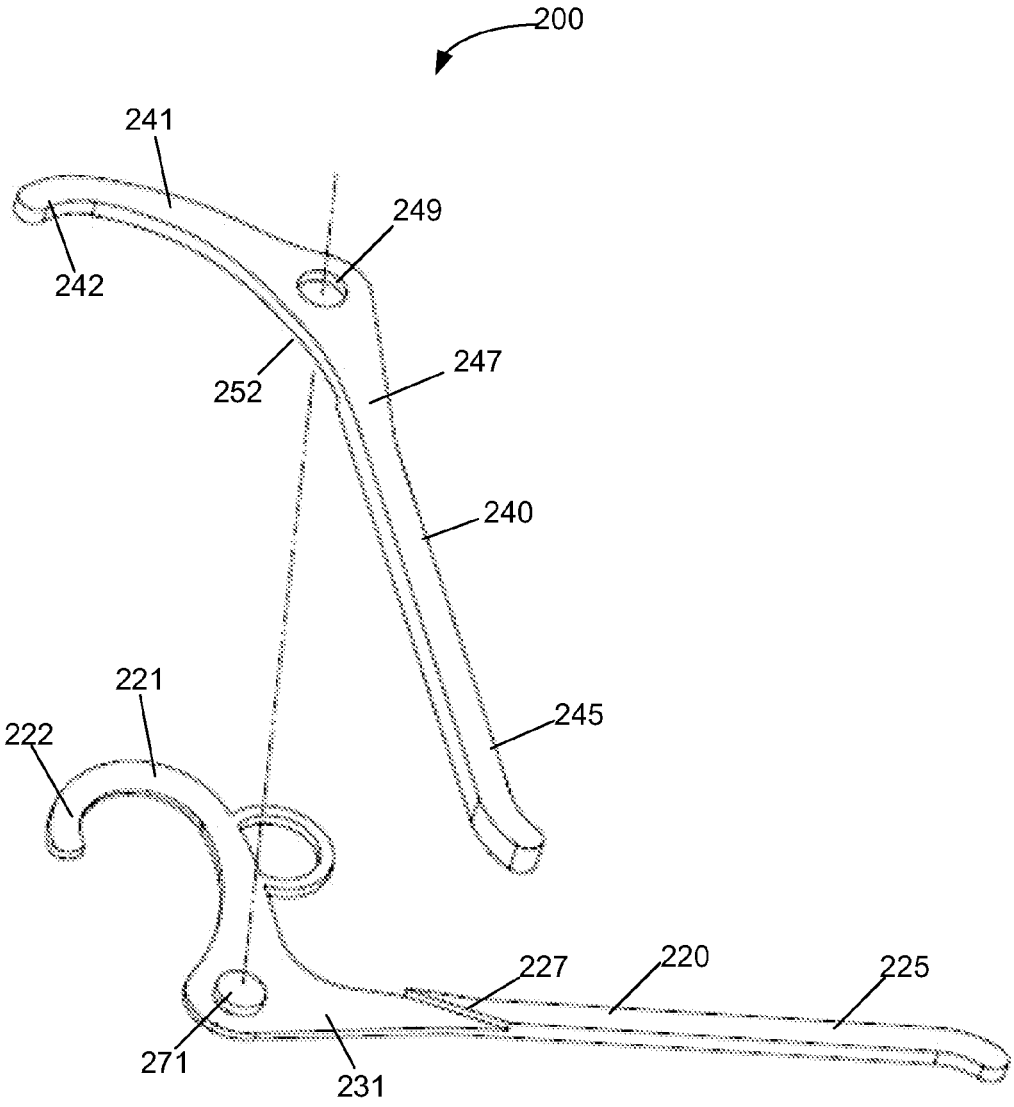
FIG. 2C is an exploded view of the collapsible hanger of FIG. 2A.

Referring now to FIGS. 2A-2C, a garment hanger 200 can include a first arm 220, having a first end portion 221 and a second end portion 225, and a second arm 240, having a first end portion 241 and a second end portion 225. The first end portion 221 of the first arm 220 can include a hook 222 that can be substantially similar in form and function as the hook 122 described with respect to FIGS. 1A-1C. Similarly, the first end portion 241 of the second arm 240 can include an extension 242 that can be substantially similar to the extension 142 described with respect to FIGS. 1A-1C. Therefore, the similar portions of the first arm 220 and the second arm 240 are not described in detail herein.

While the first arm 120 described in reference to FIGS. 1A-1C includes a first housing segment 130 and a second housing segment 134, the first arm 220 of the garment hanger 200 shown in FIG. 2A is unitarily formed. In this manner, the second arm 240 is rotatably coupled adjacent to the first arm 220. The second arm 240 can, for example, rotate about a pin 232 between a first expanded configuration (FIG. 2A) and a second collapsed configuration (FIG. 2B). More specifically, the pin 232 can be configured to extend away from an inner surface 231, as shown in FIG. 2C. Additionally, the second arm 240 can include an inner surface 252 and can define an aperture 249 configured to receive the pin 232. The inner surface 231 of the first arm 220 and the inner surface 252 of the second arm can be any suitable configuration. For example, inner surface 231 of the first arm 220 can be defined by an extrusion in the first arm 220. Similarly stated, the inner surface 231 can define a first portion 227 of the first arm 220 that is substantially thinner than a second portion 225 of the first arm 220. Similarly, the inner surface 252 of the second arm 240 can define a first portion 247 of the second arm 240 that is substantially thinner than a second portion 245 of the second arm 240. In this manner, the first arm 220 and the second arm 240 can be substantially in line (i.e., coaxial) when coupled.

The pin 232 can be any suitable size, shape, or configuration. For example, in some embodiments, the pin 232 can include a ridge or protrusion along the outer edge. The ridge or protrusion can engage the second arm 240 when the pin 232 is inserted into the aperture 249. In this manner, the ridge or protrusion can act to couple the second arm 240 to the first arm 220 while allowing for rotational motion of the second arm 240 about the pin 232. In some embodiments, the pin 232 can be a separate component configured to be inserted through an aperture in the second arm 240.

FIGS. 3A-3F illustrate a collapsible garment hanger 300 according to another embodiment. The collapsible hanger 300 includes a first arm 320 with a first end portion 321 and a second end portion 325, and second arm 340 with a first end portion 341 and a second end portion 345. The first end portion 321 of the first arm 320 includes a first hook 322 configured to be disposed over, for example, a closet rod. The first hook 322 can be any suitable shape, size, or configuration.

The second portion 325 of the first arm 320 includes a boom 326 extending away from the first end portion 321. The boom 326 can be configured to extend away from the first end portion 321 in a downward fashion such that a distal end 328 of the second portion 325 is below a proximal end 327 of the second portion, as shown, for example, in FIG. 3A. Furthermore, the boom 326 extends away from a proximal end 327 in a slightly arcuate path. The boom 326 can extend from the proximal end 327 toward the distal end 328 in any suitable path. For example, in some embodiments, the boom 326 extends in a substantially linear path.

The first end portion 341 of the second arm 340 includes a second hook 343 configured to selectively engage, for example, a closet rod. Similar to the first hook 322 of the first arm 320, the second hook 343 can be any suitable shape, size, or configuration, and as such is configured to hold the hanger 100 in a first expanded configuration. The second end portion 345 of the second arm 340 includes a boom 346 extending away from the first end portion 341. Similar to the boom 326 of the first arm 320, the boom 346 can extend away from a proximal end 347 in a downward path toward a distal end 348. Furthermore, the boom 326 of the first arm 320 and the boom 346 of the second arm 340 are configured to follow a substantially similar path in opposite directions.

The collapsible hanger 300 is configured to collapse, fold, rotate, and/or otherwise move between a first configuration and a second configuration. More specifically, in the expanded configuration (FIG. 3A), the second hook 343 of the second arm 340 is adjacent to the first hook 322 of the first arm 320. In this manner, the first hook 322 and the second hook 343 contact the closet rod, hook, handle, or the like. The second hook 343 can hold the hanger 300 in the expanded configuration and, as such, the hanger 300 can be used to hang a garment. When the hanger 300 is removed from, for example, the closet rod, and the first hook 322 and the second hook 343 are released and the first arm 320 and second arm 340 can freely rotate with respect to each other as described in more detail herein.

When the second hook 343 is no longer in contact with the closet rod, the weight of the garment, the weight of the second arm 340, and/or the user can cause the second arm 340 to rotate about the first arm 320. The second arm 340 can rotate through a range of positions shown, for example, in FIG. 3B. As the second arm 340 rotates through the range of positions, the distal end 348 of the second portion 345 moves toward the distal end 328 of the second portion 325 of the first arm 320. Furthermore, the hook 343 rotates away from the hook 322.

Figure 3A:
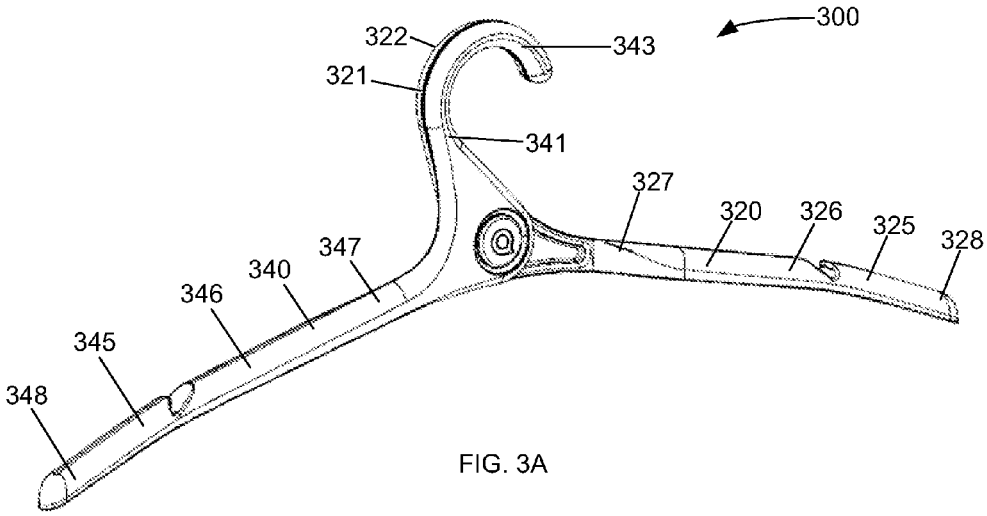
FIG. 3A is a perspective view of a collapsible hanger in an expanded configuration according to another embodiment.
Figure 3B:
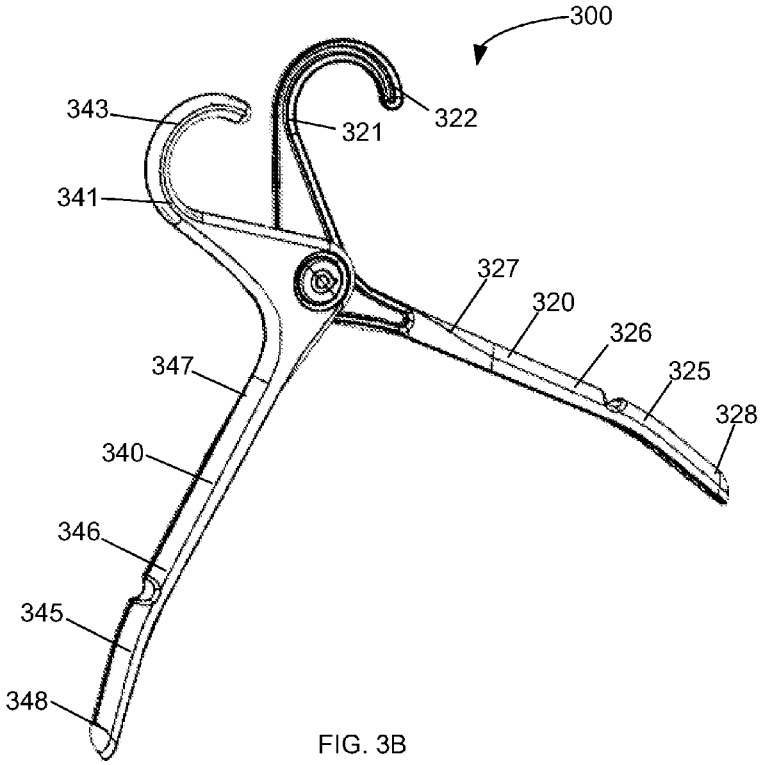
FIG. 3B is a perspective view of the collapsible hanger of FIG. 3A in a partially collapsed configuration.
Figure 3C:
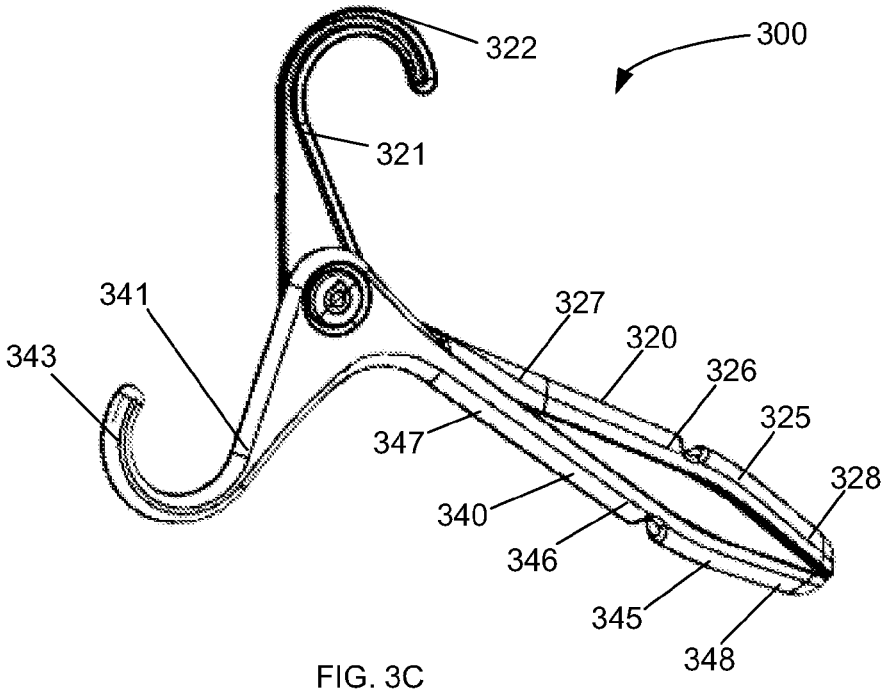
FIG. 3C is a perspective view of the collapsible hanger of FIG. 3A in a collapsed configuration.

The hanger 300 can rotate through the range of positions to a collapsed configuration, as shown, for example in FIG. 3C. In the collapsed configuration, the second portion 345 of the second arm 340 is adjacent to the second portion 325 of the first arm 340. More specifically, the distal end 348 of the second portion 345 can contact the distal end 328 of the second portion 325 stopping the rotation of the second arm 340 in the second collapsed configuration.

Figure 3D:
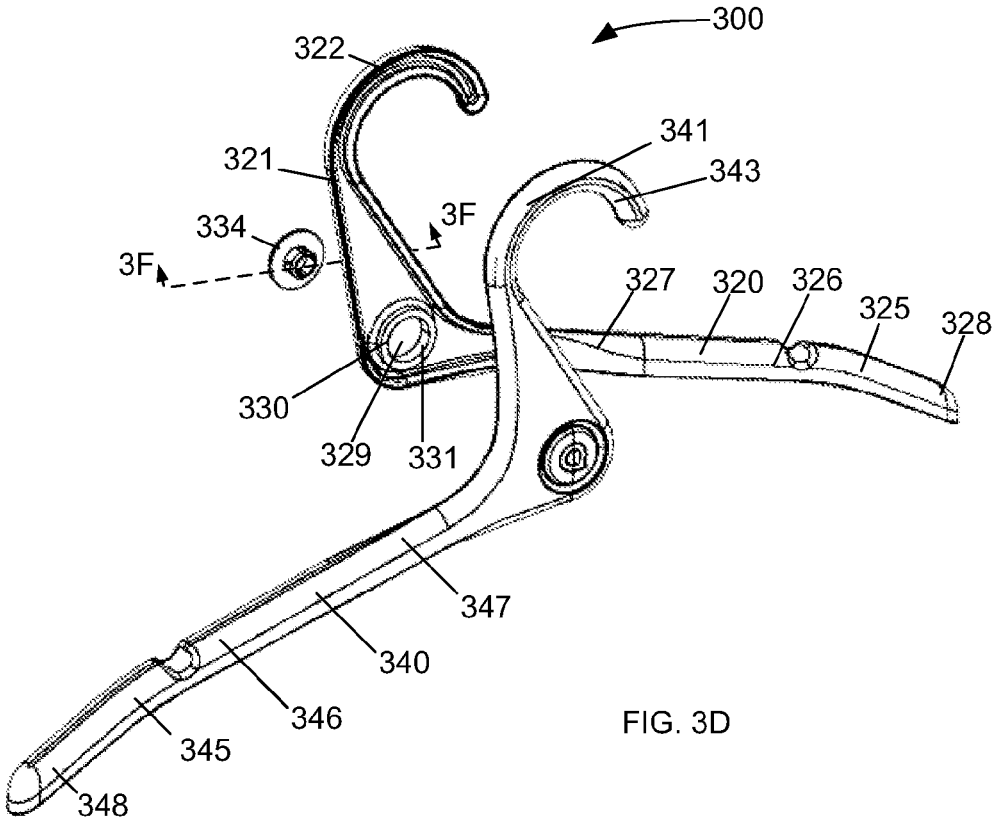
FIG. 3D is an exploded view of the collapsible hanger of FIG. 3A.
Figure 3E:
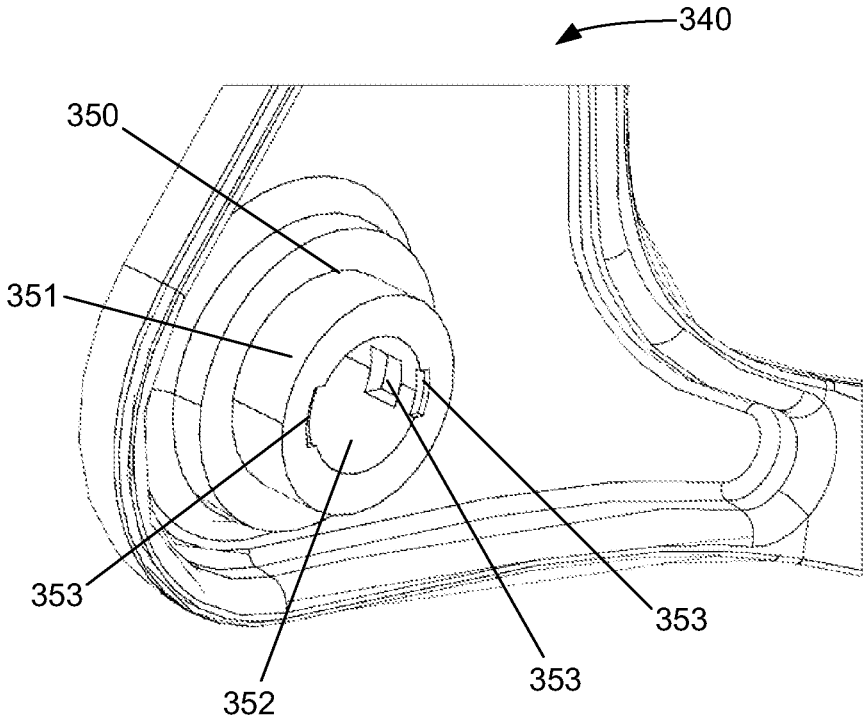
FIG. 3E is an enlarged perspective view of a portion of the collapsible hanger of FIG. 3A.

Referring now to FIG. 3D, the second arm 340 rotates within an aperture 329 defined by the first arm 320. More specifically, the first arm 320 includes a first ring 330 with an inner surface 331 that defines the aperture 329. The second arm 340 includes a second ring 350 with an outer surface 351 that extends outwardly from the second arm 340, as shown in FIG. 3E. The second ring 350 is configured to be inserted into the aperture 329 defined by the first ring 330 such that the outer surface 351 travels along the inner surface 331 when rotating between the first expanded configuration and the second collapsed configuration.

The outer surface 351 and the inner surface 331 can create a friction fit such as to resist the rotation of the second arm 340. For example, in some embodiments, the outer surface 351 of the second ring 350 is inserted into the aperture 329 defined by the inner surface 331 of the first ring 330 and can create a friction fit. In such embodiments, the friction between the outer surface 351 and the inner surface 331 can be large enough to resist the rotation of the second arm 320 under the force of its own weight (i.e., gravity). Similarly stated, the friction between the outer surface 351 and the inner surface 331 can be large enough that the hanger 300 will not collapse without additional force (e.g., a hanging garment and/or a user). Additionally, the second ring 350 includes an inner surface 352 with a set of notches 353 (FIG. 3E) that can selectively engage a coupling insert 334 configured to rotatably couple the second arm 340 to the first arm 320, as further described below.

Figure 3F:
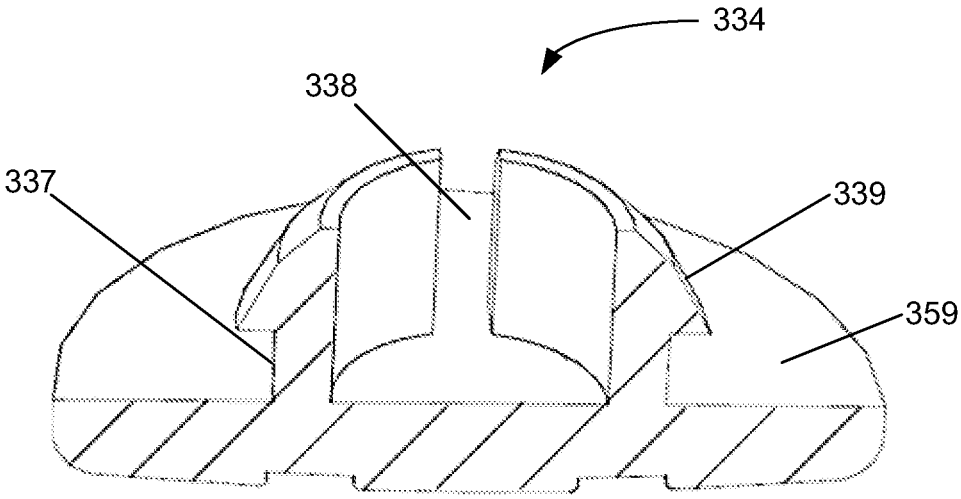
FIG. 3F is a cross-sectional view of a portion of the collapsible hanger of FIG. 3A taken along the line 3F-3F in FIG. 3D.

The coupling insert 334 can include an outer surface 337 having a pair of tabs 339 and defining a split portion 338, as shown in FIG. 3F. The coupling insert 334 can be inserted into the second ring 350 such that as the tabs 339 are inserted past the outer edge of the inner surface 352, a force can be applied that reduces the size (e.g., the distance between the opposing surfaces) of the split portion 338 of the coupling insert 334. In this manner, the diameter of the coupling insert 334 decreases. When the tabs 339 engage the notches 353 defined by the inner surface 352 of the second ring 350 the force applied to the coupling insert 334 is removed and, therefore, the coupling insert 334 returns to the first diameter. When in use, the second ring 350 is inserted into the aperture 329 of the first ring 330 and the coupling insert 334 is inserted into the second ring 350. A flat portion 359 of the coupling insert 334 contacts the outer side of the first arm 320 and thereby rotatably couples the second arm 340 to the first arm 320.

Referring now to FIGS. 4A-4G a garment hanger 400 includes a first arm 420 and a second arm 440. The first arm 420 includes a first end portion 421, a second end portion 425, and a portion of a locking mechanism 460. The first end portion 421 of the first arm 420 includes a first hook 422 configured to be disposed over, for example, a closet rod. The first hook 422 can be any suitable shape, size, or configuration such as, for example, those described with respect to the hanger 100 of FIGS. 1A-1C.

The second arm 440 also includes a first end portion 441, a second end portion 425, and a portion of a locking mechanism 460. The first end portion 441 of the second arm 440 includes a second hook 443 configured to selectively engage, for example, a closet rod. Similar to the first hook 422 of the first arm 420, the second hook 443 can be any suitable shape, size, or configuration, and as such is configured to hold the hanger in a first expanded configuration.

The second portion 425 of the first arm 420 includes a boom 426 extending away from the first end portion 421. Similarly, the second end portion 445 of the second arm 440 includes a boom 446 extending away from the first end portion 441. The structure and functionality of the second portion 425 of the first arm 420 and the second portion 445 of the second arm 440 is substantially similar to the structure and function of the second portion 325 and the 345, respectively, and, therefore, is not described in detail herein.

Figure 4A:
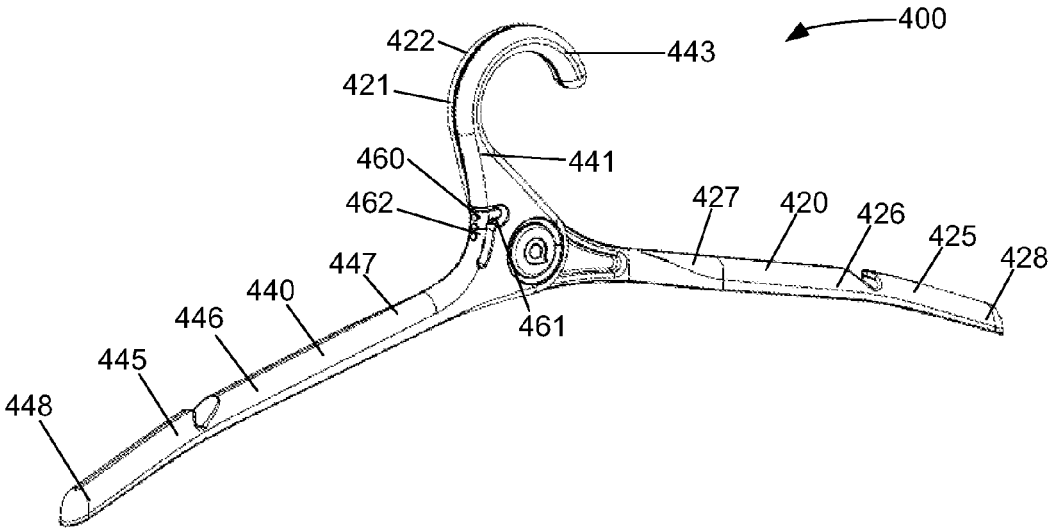
FIG. 4A is a perspective view of a collapsible hanger in an expanded configuration according to another embodiment.
Figure 4B:
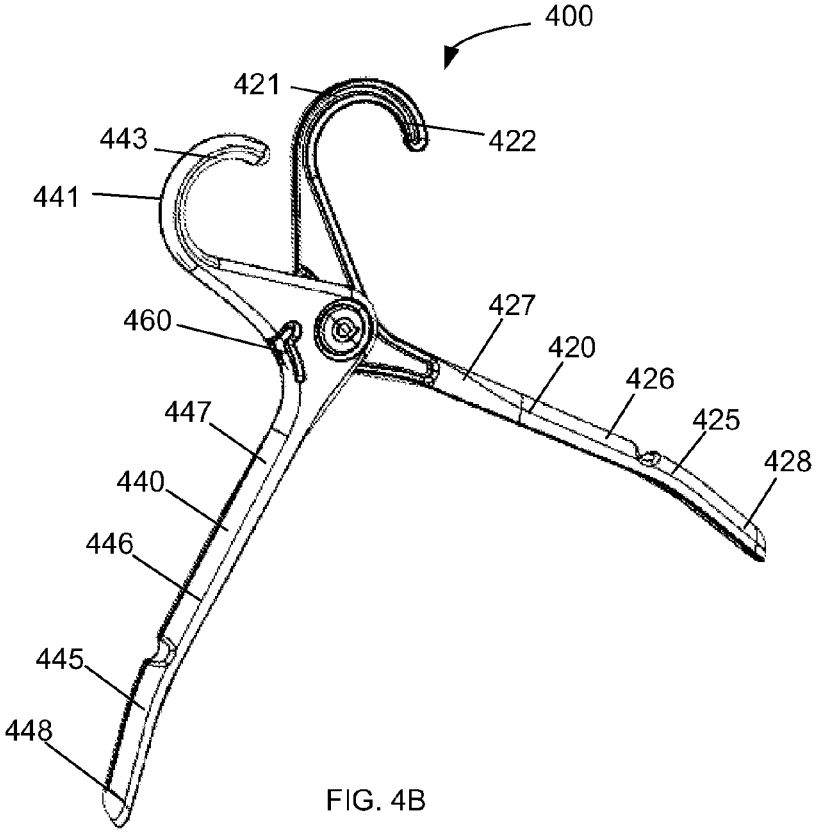
FIG. 4B is a perspective view of the collapsible hanger of FIG. 4A in a partially collapsed configuration.
Figure 4C:
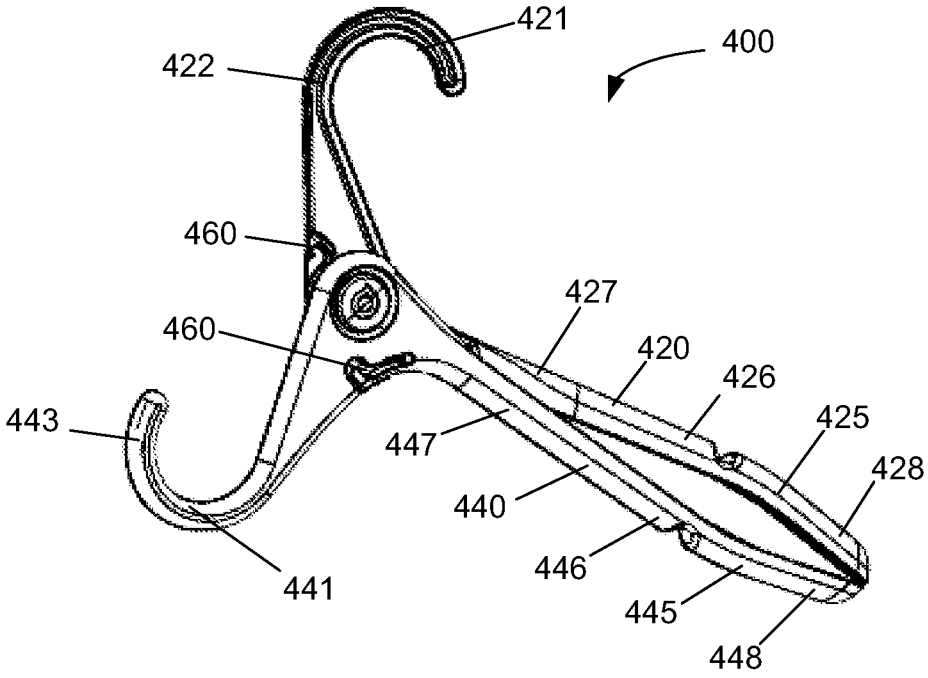
FIG. 4C is a perspective view of the collapsible hanger of FIG. 4A in a collapsed configuration.

The hanger 400 is configured to collapse, fold, rotate, and/or otherwise move from the expanded configuration (FIG. 4A), to a partially collapsed intermediate configuration, as shown, for example in FIG. 4B, and to a collapsed configuration, as shown, for example in FIG. 4C. More specifically, the first expanded configuration (FIG. 4A), is such that the second hook 443 of the second arm 440 is adjacent to the first hook 422 of the first arm 420. In this manner, the first hook 422 and the second hook 443 contact the closet rod, the hook, the handle, and/or the like. The second hook 443 can hold the hanger 400 in the first expanded configuration and, as such, the hanger 400 can be used to hang a garment. When the hanger 400 is removed from, for example, the closet rod, the second hook 443 no longer holds the hanger in the first expanded configuration. The second arm 440 can rotate within an aperture 429 (FIG. 4D) defined by the first arm 420, as described in more detail herein.

With the second hook 443 no longer in contact with the closet rod, the weight of the garment and/or the weight of the second arm 440 can cause the second arm 440 to rotate about the first arm 420. The second arm 440 can rotate through a range of positions shown, for example, in FIG. 4B. As the second arm 440 rotates through the range of positions, the distal end 448 of the second portion 445 moves toward the distal end 428 of the second portion 425 of the first arm 420. Furthermore, the hook 443 rotates away from the hook 422. In some embodiments, the locking mechanism 460 can be configured to hold the second arm 440 in any one of a range of positions. In other embodiments, the first arm 420 and the second arm 440 are coupled together such that sufficient frictional force exists to hold the second arm 440 in any one of a range of positions with respect to the first arm 420.

The hanger 400 can rotate through the range of positions to the second collapsed configuration, as shown, for example in FIG. 4C. In the collapsed configuration, the second portion 445 of the second arm 440 is adjacent to the second portion 425 of the first arm 440. More specifically, the distal end 448 of the second portion 445 can contact the distal end 428 of the second portion 425 stopping the rotation of the second arm 440 in the second collapsed configuration.

Figure 4D:
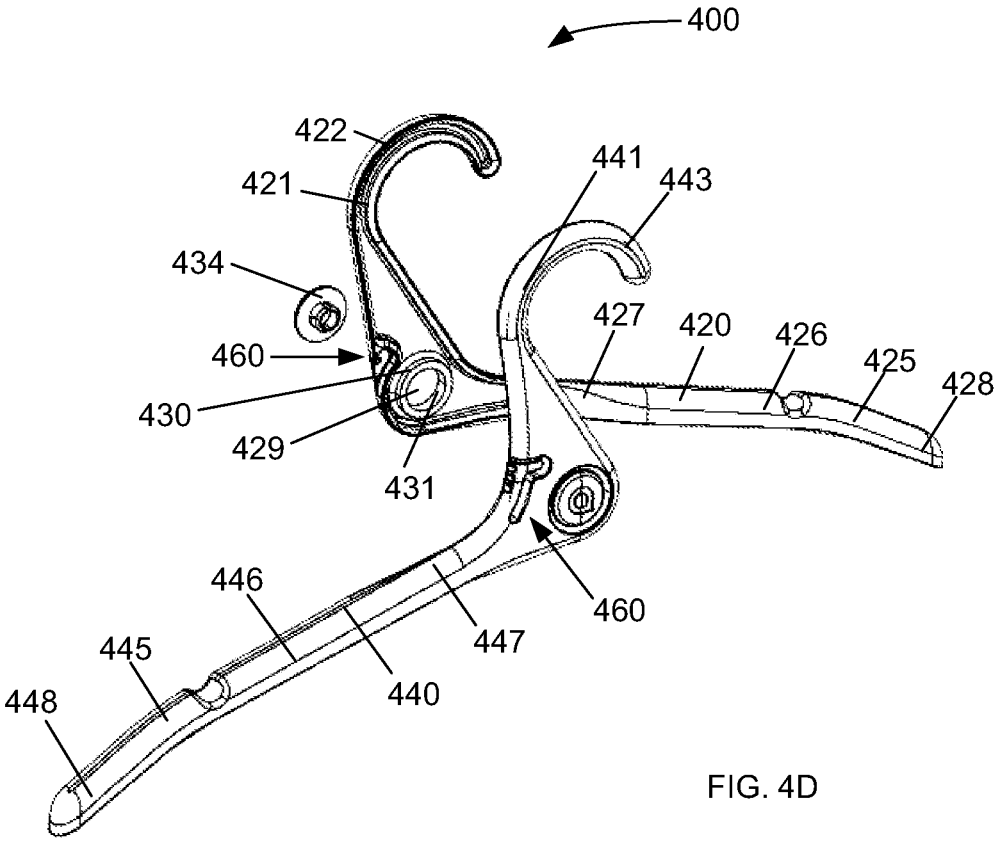
FIG. 4D is an exploded view of the collapsible hanger of FIG. 4A.

As described above with respect to FIGS. 4A-4C, the second arm 440 rotates within the aperture 429 defined by the first arm 420. More specifically, the first arm 420 includes a first ring 430 with an inner surface 431 that defines the aperture 429, as shown in FIG. 4D. The second arm 440 includes a second ring 450 with an outer surface 451 (FIG. 4F) that extends outwardly from the second arm 440. The second ring 450 is configured to be inserted into the aperture 429 such that the outer surface 451 travels along the inner surface 431 of the first ring 430 when rotating between the first expanded configuration and the second collapsed configuration. A coupling insert 434 removably couples to the second ring 450 and includes a flat portion 459 that can contact the first arm 420, thereby rotatably coupling the second arm 440 to the first arm 420. The structure and functionality of the second ring 450 and the coupling insert 434 are substantially similar to the structure and functionality of the first ring 350 and the coupling insert 334, and are therefore not described in detail.

Figure 4E:
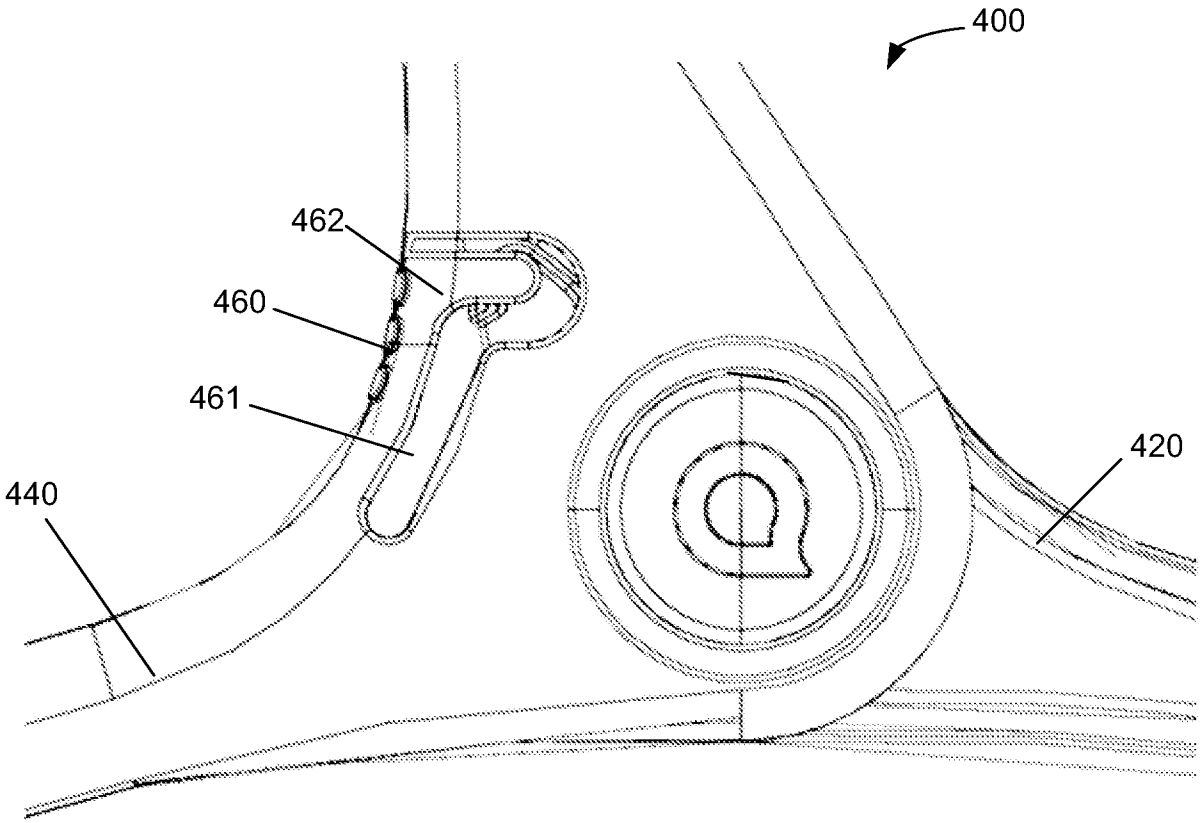
FIG. 4E is an enlarged front view of a portion of a locking mechanism of the collapsible hanger of FIG. 4A.
Figure 4F:
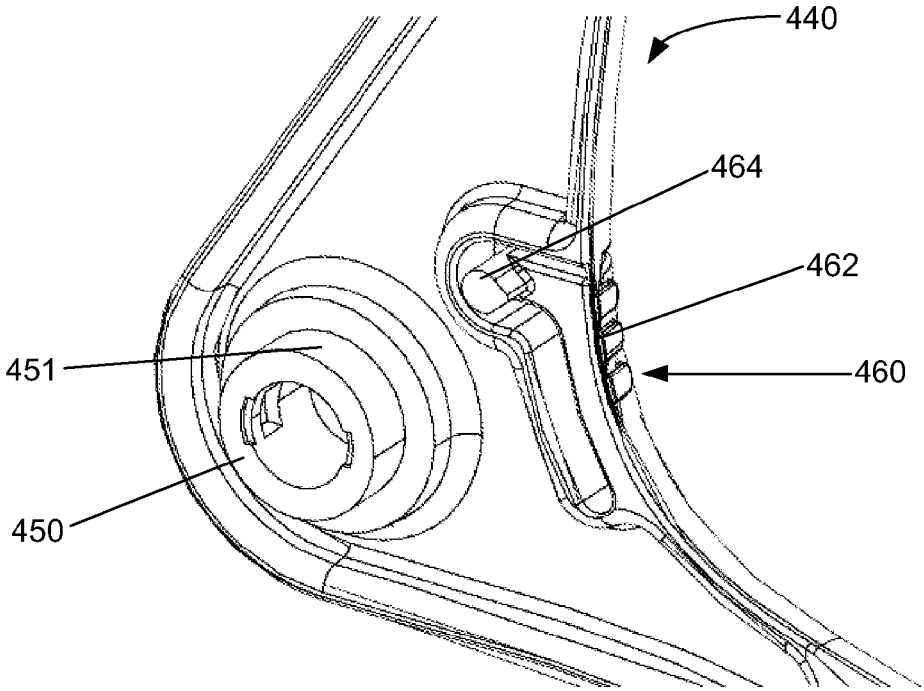
FIG. 4F is an enlarged rear perspective view of a portion of a locking mechanism of the collapsible hanger of FIG. 4A.
Figure 4G:
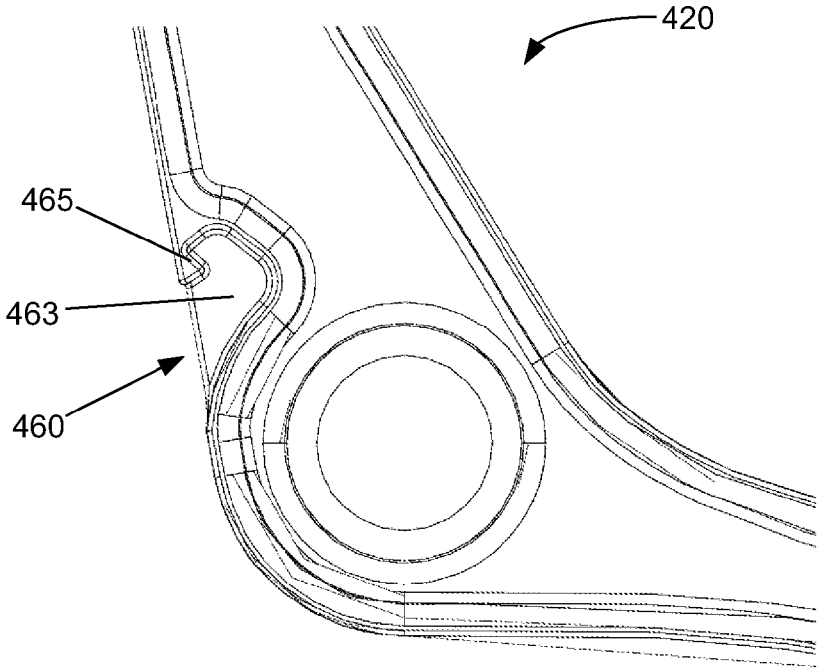
FIG. 4G is an enlarged front view of a portion of a locking mechanism of the collapsible hanger of FIG. 4A.

Referring now to FIGS. 4E-4G, the hanger 400 includes a locking mechanism 460 configured to hold the hanger 400 in the first expanded configuration. More specifically, the second arm 440 defines a relief cut 461 and includes a locking arm 462 and a pin 464 (FIGS. 4E and 4F). The first arm 420 defines a channel 463 and includes a securing protrusion 465 (FIG. 4G). The relief cut 461 can selectively allow the locking arm 462 to flex, rotate, bend, and/or otherwise move between a first undeformed configuration and a second deformed configuration. The inner surface of the locking arm 462 (FIG. 4F) includes the pin 464. The pin 464 is configured to removably engage the securing protrusion 465 and thereby lock the hanger 400 in the first expanded configuration.

For example, a user can apply a force to the locking arm 462 in the direction of the first arm 420. The configuration of the relief cut 461 can allow the locking arm 462 to deform, such that the pin 464 disengages (i.e., moves away from) the securing protrusion 465. The pin 464 can travel in the channel 463, and, as gravity, the weight of a garment, a force applied by the user, and/or any other suitable force causes the second arm 440 to rotate (as described above), the pin 464 disengages the portion of the locking mechanism 460 included in the first arm 420. Alternatively, when returning to the first expanded configuration, the pin 464 can travel in the channel 463 in the direction of the first arm 420. The user can remove the force applied to the locking arm 462, in which case, the locking arm 462 returns to the undeformed configuration and can engage the securing protrusion 465, thereby locking the hanger 400 in the first expanded configuration.

The garment hanger described herein can be formed of any suitable material or using any suitable method. Furthermore, various components can be of similar or different materials. Similarly, various components of the hanger can be unitarily formed or be comprised of multiple parts. For example, with respect to FIG. 1A, the hanger 100 can be formed of a plastic. An over-mold can be used to apply a layer of rubber material over the plastic base layer of the hanger 100 at the position of the finger support 144 to modify the characteristic the finger support 144, such as, for example, increase the ergonomics.

In some embodiments, the booms of the first arm and the second arm can include an indentation such as, for example, a recess, slot or notch. The indentations can be used, for example, to hang garments that include straps. The straps of the garment can engage the indentation and as such are less likely to slide off the hanger.

While various embodiments have been described above, it should be understood that they have been presented by way of example only, and not limitation. Where schematics and/or embodiments described above indicate certain components arranged in certain orientations and/or positions, the arrangement of components may be modified. Similarly, where methods and/or events described above indicate certain events and/or procedures occurring in certain order, the ordering of certain events and/or procedures may be modified. While the embodiments have been particularly shown and described, it will be understood that various changes in form and details may be made.

What is claimed is:

1. A garment hanger comprising:

a first arm having a first end portion and a second end portion, the first end portion having a hook configured to be disposed over a closet rod to support the garment hanger;

a second arm having a first end portion and a second end portion, the second arm coupled to the first arm for rotational movement relative to the first arm between an expanded configuration and a collapsed configuration, the first end portion of the second arm configured to selectively engage the closet rod and hold the garment hanger in the expanded configuration; and a locking mechanism configured to lock the garment hanger in the expanded configuration, the locking mechanism including a locking arm having a pin coupled to at least one of the first and the second arm, a channel having a securing protrusion disposed in the other of the first and the second arm, and a relief cut configured to allow the locking arm to move from a first configuration to a second configuration, the locking arm movable between the first configuration such that the pin selectively engages the securing protrusion to lock the garment hanger in the expanded configuration, and the second configuration such that the pin selectively releases from the securing protrusion and allows the second arm to rotate with respect to the first arm from the expanded configuration to the collapsed configuration.

2. The garment hanger of claim 1, wherein the first arm includes a first segment and a second segment.

3. The garment hanger of claim 1, wherein the first arm includes a first segment and a second segment, the first segment and the second segment collectively defining a slot for receiving the second arm.

4. The garment hanger of claim 3, wherein the second arm is rotatable about a pin disposed in the slot of the first arm.

5. The garment hanger of claim 1, wherein the second arm is rotatable about a pin disposed on the first arm.

6. The garment hanger of claim 5, wherein the second arm includes a aperture configured to receive the pin disposed on the first arm.

7. The garment hanger of claim 1, wherein the hook is a first support hook, and the first end portion of the second arm includes a second support hook configured to hold the garment hanger in the expanded configuration.

8. The garment hanger of claim 1, wherein the locking mechanism is further configured to lock the garment hanger in an intermediate configuration.

9. The garment hanger of claim 1, further comprising a pivot member, the pivot member configured to couple the first arm to the second arm for rotational movement relative to the second arm.

10. The garment hanger of claim 9, wherein the pivot member is disposed on the first arm.

11. The garment hanger of claim 9, wherein the pivot member is received through an aperture in the first arm.

12. The garment hanger of claim 1, wherein the relief cut is configured to selectively allow the locking arm to at least one of move, flex, rotate, and bend between a first undeformed configuration and a second deformed configuration.

13. A garment hanger comprising:

a support hook;

a first arm coupled to the support hook; and a second arm coupled to the first arm for rotational movement relative to the first arm between and configured to selectively engage a closet rod and hold the garment hanger in an expanded configuration, the second arm including a locking arm having a pin configured to selectively engage a securing protrusion disposed in a channel defined by the first arm, wherein the second arm includes a relief cut configured to allow the locking arm to move between a first configuration such that the pin selectively engages the securing protrusion to lock the second arm in the expanded configuration, and a second configuration such that the pin selectively releases from the securing protrusion and allows the second arm to rotate with respect to the first arm from the expanded configuration to a collapsed configuration.

14. The garment hanger of claim 13, wherein the support hook is a first support hook, the second arm further including a second support hook configured to hold the garment hanger in the expanded configuration.

15. The garment hanger of claim 13, wherein the first arm is unitarily formed with the support hook.

16. The garment hanger of claim 13, wherein the relief cut is configured to selectively allow the locking arm to at least one of move, flex, rotate, and bend between a first undeformed configuration and a second deformed configuration.

* * * * *